US007278254B2

(12) United States Patent
Youngblood

(10) Patent No.: US 7,278,254 B2
(45) Date of Patent: Oct. 9, 2007

(54) COOLING SYSTEM FOR A TRANSITION BRACKET OF A TRANSITION IN A TURBINE ENGINE

(75) Inventor: Bradley T. Youngblood, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 360 days.

(21) Appl. No.: 11/044,766

(22) Filed: Jan. 27, 2005

(65) Prior Publication Data

US 2006/0162314 A1 Jul. 27, 2006

(51) Int. Cl.
*F23R 3/42* (2006.01)

(52) U.S. Cl. ..... 60/39.37; 60/752; 60/800

(58) Field of Classification Search ..... 60/39.37, 60/752, 760, 800
See application file for complete search history.

(56) References Cited

U.S. PATENT DOCUMENTS

| | | | | |
|---|---|---|---|---|
| 4,719,748 | A | 1/1988 | Davis, Jr. et al. | |
| 5,749,218 | A | 5/1998 | Cromer et al. | |
| 5,761,898 | A | 6/1998 | Barnes et al. | |
| 6,345,494 | B1 | 2/2002 | Coslow | |
| 6,412,268 | B1 | 7/2002 | Cromer et al. | |
| 6,442,946 | B1 | 9/2002 | Kraft et al. | |
| 6,568,187 | B1 | 5/2003 | Jorgensen et al. | |
| 6,571,560 | B2 * | 6/2003 | Tatsumi et al. | 60/800 |
| 6,619,915 | B1 | 9/2003 | Jorgensen | |
| 6,640,547 | B2 | 11/2003 | Leahy, Jr. | |
| 6,644,032 | B1 | 11/2003 | Jorgensen et al. | |
| 6,662,567 | B1 | 12/2003 | Jorgensen | |
| 6,675,584 | B1 | 1/2004 | Hollis et al. | |
| 2003/0167776 | A1 * | 9/2003 | Coppola | 60/752 |
| 2004/0031271 | A1 | 2/2004 | Jorgensen | |

FOREIGN PATENT DOCUMENTS

JP 2003-322337 * 11/2003

* cited by examiner

*Primary Examiner*—Ted Kim

(57) ABSTRACT

A heat shield for a transition of a turbine engine for coupling a transition component of a turbine engine to a turbine vane assembly to direct combustor exhaust gases from the transition into the turbine vane assembly. The heat shield may be capable of reducing the temperature differential across a transition bracket extending from a transition component, thereby reducing the likelihood of premature failure of the bracket or the transition, or both. The heat shield may reduce the temperature differential by insulating the transition bracket and transition bracket rib from cooling gases. The heat shield may be formed from a tubular elongated body having first and second end attachments configured to attach the elongated heat shield body to the transition.

12 Claims, 5 Drawing Sheets

COOLING SYSTEM FOR A TRANSITION BRACKET OF A TRANSITION IN A TURBINE ENGINE

FIELD OF THE INVENTION

This invention is directed generally to transitions in turbine engines between combustors and turbine vane assemblies for directing exhaust gases into the turbine vane assemblies and, more particularly, to devices for cooling turbine brackets used to attached transitions in turbine engines.

BACKGROUND

Typically, gas turbine engines operate at high temperatures that may exceed 2,500 degrees Fahrenheit. During operation, turbine engines expose turbine vane assemblies, transitions, and other components to these high temperatures. As a result, these components must be made of materials capable of withstanding such high temperatures. Typically, transition sections are coupled to a blade ring or other component of a turbine vane assembly. The transition sections are often attached using a bracket. During operation, the bracket is heated on one edge by the transition and cooled on another edge by cooling gases. As a result, a large temperature differential is developed in the transition bracket as the end of the bracket coupled to the transition becomes very hot and the other end opposite the end coupled to the transition is cooled with cooling gases. This large temperature differential often causes premature failure of the transition brackets or transitions, or both, in turbine engines. Thus, a need exists for a system for attaching transitions to turbine vane assemblies in a turbine engine that reduces the likelihood of premature failure of the attachment system.

SUMMARY OF THE INVENTION

This invention relates to a heat shield for a transition bracket in a can-annular combustion system of a turbine engine, whereby the transition bracket is used to couple a transition to a blade ring or other component of a turbine blade assembly to direct combustion exhaust gases from a combustor to a turbine blade assembly. The heat shield insulates the transition bracket from the cooling gases so that the bracket is not exposed to large temperature differentials, and therefore is not as susceptible to premature failure.

The heat shield may be formed from an elongated body configured to be coupled to an outer surface of a transition. In at least one embodiment, the elongated body may be tubular and have a generally teardrop shaped cross section. The elongated body may include a top surface and a bottom surface. The elongated body may include an opening in the bottom surface configured to receive a transition bracket rib attached to a transition and an opening in a top surface enabling a transition bracket to protrude through the elongated body. The elongated body may have a cross-section formed from a top portion having a generally hemispherical shape and two sides extending from the top portion toward each other. The two sides may extend generally toward each other and may include flared ends that extend generally away from each other and away from a longitudinal axis. The heat shield may also include first and second end attachments for closing the ends of the elongated body. The first and second end attachments may include slots for receiving the transition bracket rib.

The heat shield may be attached to an outer surface of a transition in a turbine engine. The heat shield may be attached to the transition bracket rib using an interference fit by placing the body over the transition bracket rib so that the transition bracket rib rests within the opening between the two sides forming the elongated body. In other embodiments, the heat shield may be attached to the transition using welds or other such connections. Once the heat shield is in place, the transition bracket may protrude through the heat shield. The transition bracket may include apertures or other devices for attaching the transition bracket to a blade ring or other component of a turbine vane assembly.

During operation of a turbine engine, the transition directs exhaust gases from a combustor into a turbine blade assembly. As a result, the transition becomes very hot as does one edge of the transition bracket. The other edge of the transition bracket remains cool due to its exposure to cooling gases. The heat shield insulates the transition bracket from the cooling gases, and thus, the transition bracket maintains a relatively consistent temperature throughout the bracket.

An advantage of this invention is that the heat shield enables a transition bracket to maintain a relatively even temperature throughout the bracket, or at least, enables a transition bracket to reduce the temperature differential in the bracket relative to conventional systems, such that the likelihood of premature failure of a transition or a transition bracket, or both, is substantially reduced relative to conventional designs.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

As shown in FIGS. 1-7, this invention is directed to a heat shield 10 for a transition bracket 12 in a can-annular combustion system of a turbine engine. The heat shield 10 is configured to insulate the transition bracket 12 and a transition bracket rib 34 from cooling gases found in turbine engines. By insulating the transition bracket 12 and the transition bracket rib 34 from cooling gases, the transition bracket 12 and the transition bracket rib 34 do not experience as large a temperature differential across the length of the transition bracket 12 and the transition bracket rib 34. As a result, the transition bracket 12, the transition bracket rib 34, and the transition 14 are less prone to premature failure.

Figure 1:
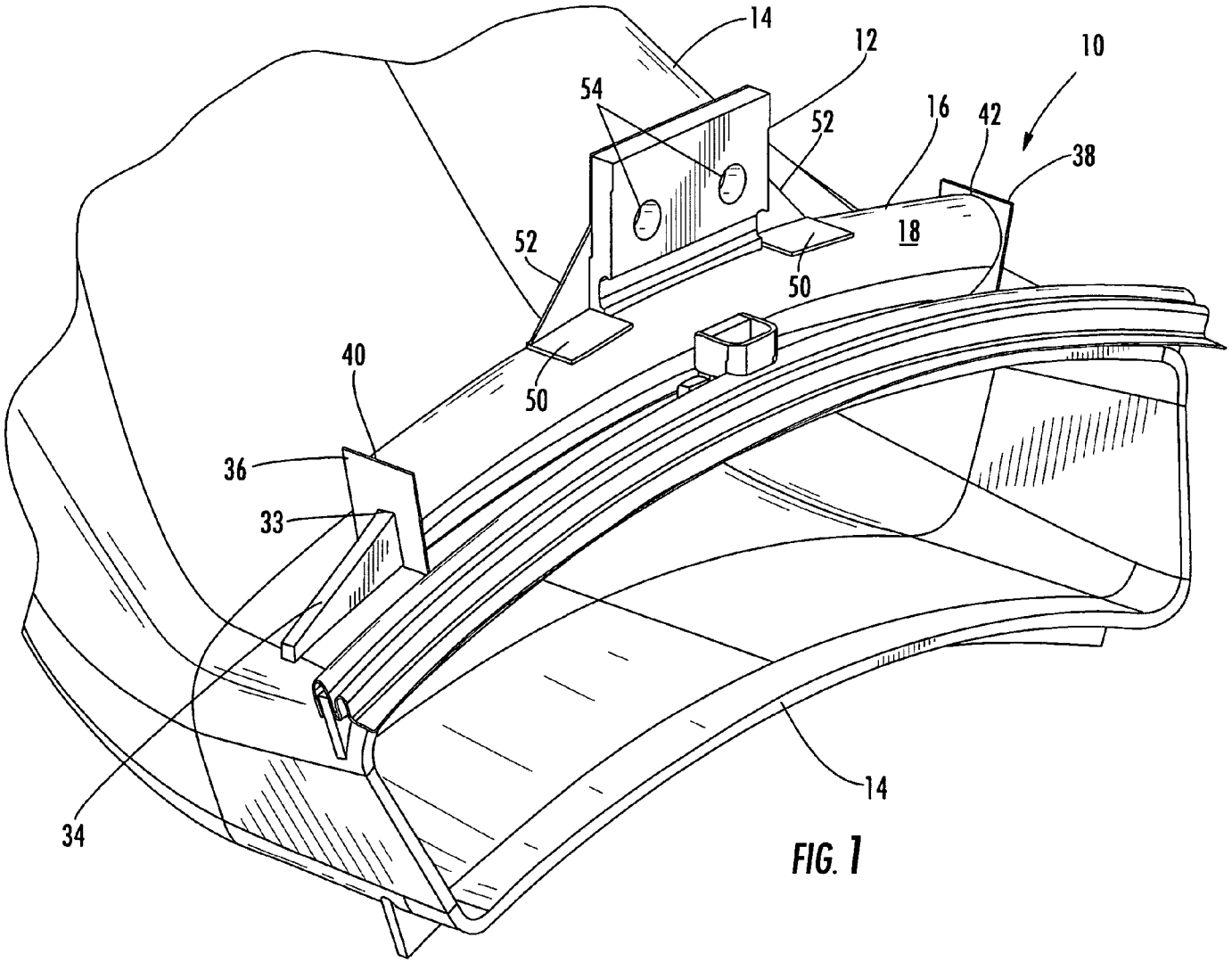
FIG. 1 is a perspective view of a transition in a turbine engine with a transition heat shield and transition bracket attached to the transition.
Figure 2:
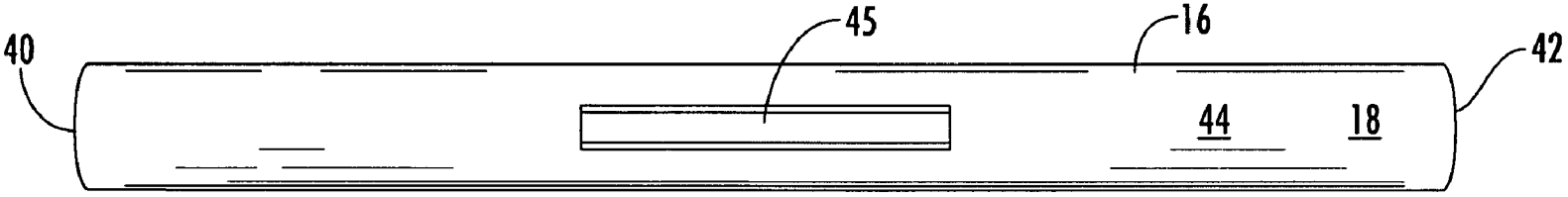
FIG. 2 is a top plan view of a heat shield of this invention.
Figure 3:
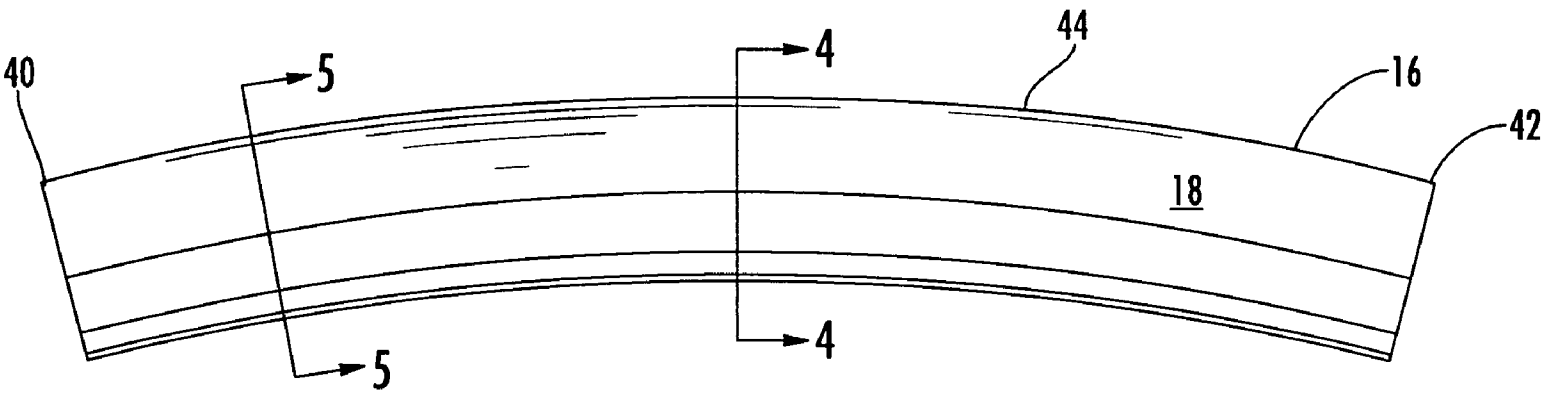
FIG. 3 is a front view of the heat shield shown in FIG. 2.
Figure 4:
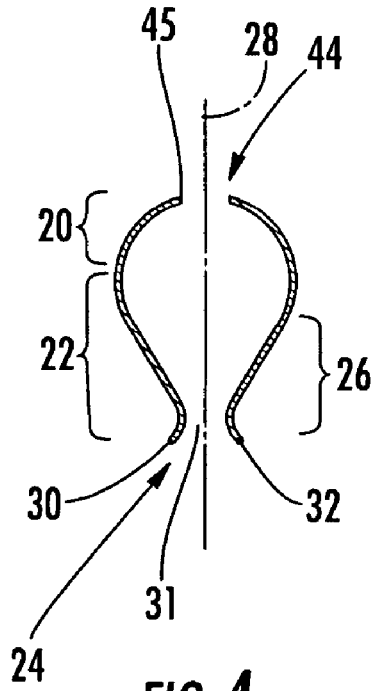
FIG. 4 is a cross-sectional view of an elongated body forming the heat shield shown in FIG. 3 taken at section line 4-4.
Figure 5:
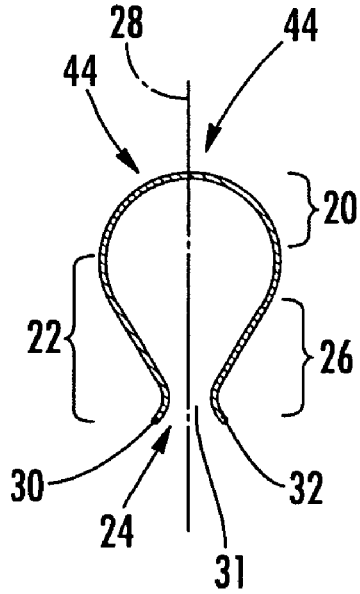
FIG. 5 is a cross-sectional view of an elongated body forming the heat shield shown in FIG. 3 taken at section line 5-5.

As shown in FIGS. 1-3, the heat shield 10 is formed from an elongated body 16 that is configured to be attached to a transition 14 of a combustion system of a turbine engine. In at least one embodiment, the elongated body 16 is configured to be attached to a transition 14 proximate to an outer surface 18 of the transition 14. The elongated body 16 may have a generally teardrop shaped cross-section, as shown in FIGS. 4 and 5. The elongated body 16 may be formed from a generally hemispherical top portion 20, a first side 22 extending from the top portion 20 and forming a portion of a bottom surface 24, and a second side 26 extending from the top portion 20 and forming a portion of the bottom surface 24. The first and second sides 22, 26 extend from the hemispherical top portion 20 generally inward toward each other so that when the first and second sides 22, 26 terminate away from the top portion 20, the first and second sides 22, 26 are closer to each other, and to a longitudinal axis 28, than at the location the first and second sides 22, 26 extend from the top portion 20. The first and second sides 22, 26 form an opening 31 in the elongated body 16 for receiving a transition bracket rib 34 and a transition bracket 12 on the transition 14. The first and second sides 22, 26 may include flared ends 30, 32, respectively, opposite the location at which the first and second sides 22, 26 extend from the top portion 20. The flared ends 30, 32, may be flared to facilitate inserting the elongated body 16 onto a transition bracket rib 34 and the transition bracket 12 extending from the outer surface 18 of the transition 14. In at least one embodiment, the transition bracket rib 34 and the transition bracket 12 may be one continuous piece. The heat shield may be formed form heat resistant alloys, such as, but not limited to, INCONEL ALLOY X-750, which is a nickel-chromium based alloy, HASTELLOY X, which is a nickel based alloy, INSONEL 617, and HAYNES 230.

Figure 6:
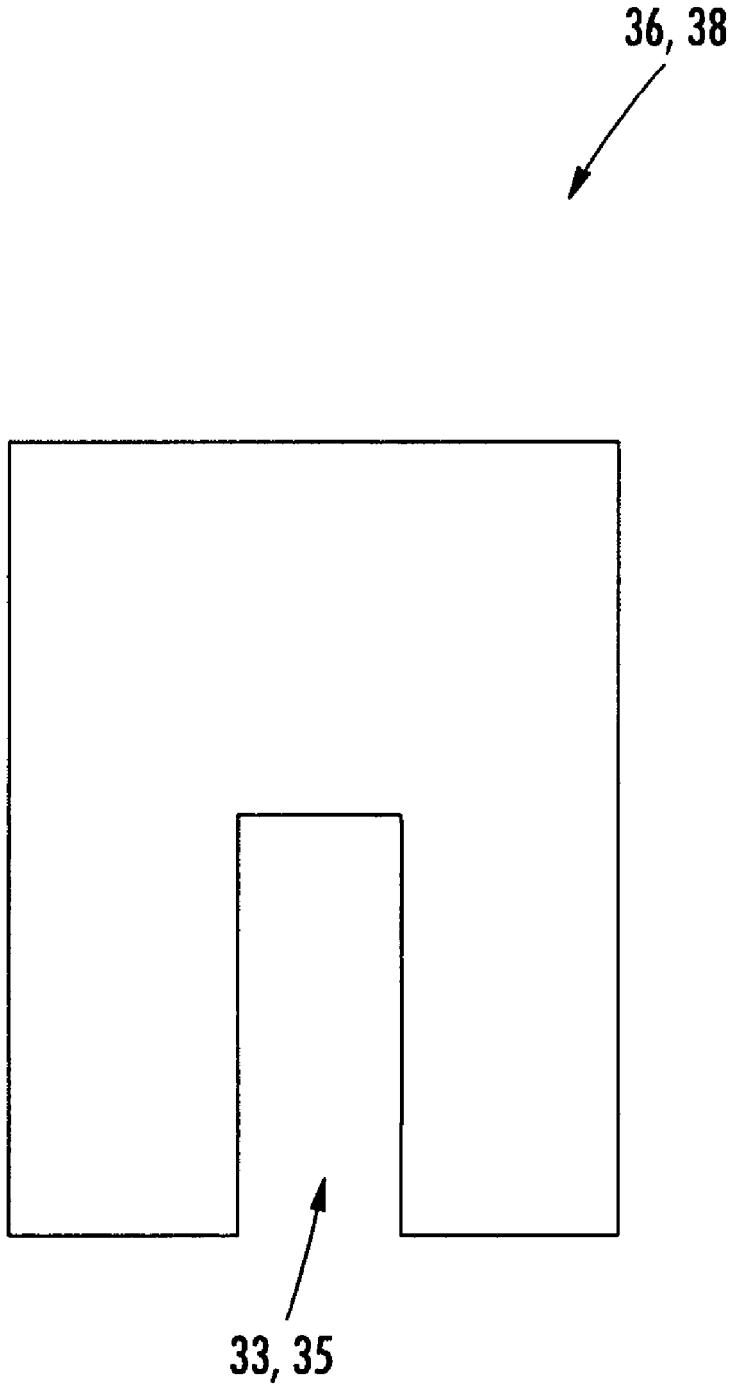
FIG. 6 is a front view of an end attachment.

The heat shield 10 may also include a first end attachment 36 and a second end attachment 38 for closing the open ends of the elongated body 16, as shown in FIG. 1. The first end attachment 36 may be coupled to a first end 40, and the second end attachment 38 may be coupled to a second end 42. As shown in FIG. 6, the first and second end attachments 36, 38 may include slots 33, 35 respectively, which may be sized to receive the transition bracket rib 34. The first and second end attachments 36, 38 may be coupled to the elongated body 16 such that the flared ends 30, 32 contact the transition bracket rib 34, as shown in FIGS. 4 and 5. The flared ends may or may not contact the outer surface 18 of the transition 14 when the elongated body 16 is inserted onto the transition bracket rib 34.

Figure 7:
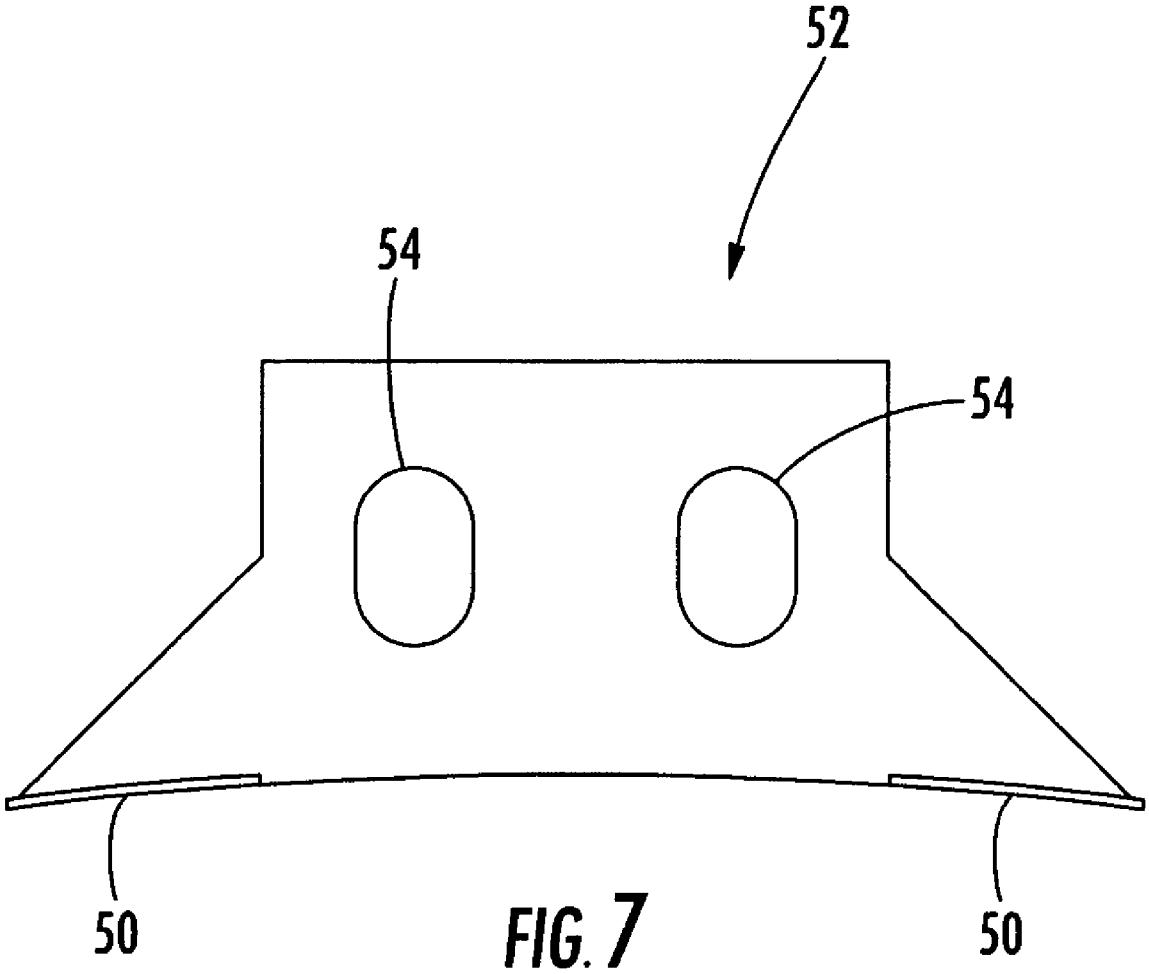
FIG. 7 is a front view of an adapter plate.

A transition bracket 12 may extend from the elongated body 16 so that the bracket 12 extends generally through a top surface 44 of the elongated body 16. In at least one embodiment, as shown in FIG. 1 and 2, the elongated body 16 may include a slot 45 enabling the transition bracket 12 to extend through the elongated body 16. An adapter plate 52 may be attached to the transition bracket 12 to prevent the elongated body 16 from being removed. The transition bracket 12 may also include one or more orifices 54 for receiving a connector, such as, but not limited to a bolt or other such device for attaching the bracket to a turbine vane assembly. The adapter plate 52 may be attached to the transition bracket 12 using a mechanical connector, such as bolts inserted through orifices 54, or other appropriate methods. The adapter plate 52, as shown in FIGS. 1 and 7, may include one or more attachment feet 50 for attaching the transition bracket 12 to the top surface 44. Attachment feet 50 may be generally parallel to the top surface 44 and a body 52 may extend generally orthogonal to the attachment foot 50. The adapter plate 52 may be formed from heat resistant alloys, such as, but not limited to, HASTELLOY X, which is a nickel-based alloy, INSONEL 617, and HAYNES 230.

The heat shield 10 may be installed on a transition bracket rib 34 by sliding the elongated body 16 onto the transition bracket rib 34 so that the transition bracket rib 34 and the transition bracket 12 protrude through the opening 31. The first and second sides 22, 26 may extend from the top portion 20 such that a width of the opening 31 is narrower than a width of the transition bracket rib 34, thereby creating an interference fit when the elongated body 16 is inserted onto the transition bracket rib 34. The transition bracket 12 attached to the heat shield 10 may be coupled to a blade ring or other component of a turbine blade assembly so that exhaust gases produced during operation of a turbine engine may be directed into the turbine blade assembly via the transition 14. These gases heat the transition 14, the transition bracket rib 34, and the transition bracket 12. However, the heat shield 10 insulates the transition bracket 12 and the transition bracket rib 34 from the cooling gases surrounding the transition 14. As a result, the transition bracket 12 and the transition bracket rib 34 maintain an even or relatively even temperature across its height and thus, is less likely to fail prematurely.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A transition in a can-annular combustion system of a turbine engine having a heat shield, comprising:

an elongated body configured to be coupled to an outer surface transition of a turbine engine between a combustor and a turbine blade assembly and including a top surface enabling a transition bracket to pass through the elongated body and a bottom surface configured to be proximate to an outer surface of a transition of the turbine engine, the transition bracket extending through the elongated body and away from a transition of the turbine engine;

an adapter plate coupled to the transition bracket for retaining the elongated body proximate to a transition of a turbine engine; and a first end attachment coupled to a first end of the elongated body that closes the first end of the elongated body, whereby the first end attachment includes a slot for receiving a transition bracket rib;

wherein the elongated body is hollow and generally tubular with an opening in the bottom surface of the elongated body.

2. The transition of claim 1, wherein the elongated body comprises a cross-section having a generally hemispherical top portion supported by a first side that extends from the hemispherical top portion and forms a portion of the bottom surface and supported by a second side that extends from the hemispherical top portion and forms a portion of the bottom surface, whereby the first and second sides extend from the hemispherical shaped top portion and form a generally teardrop shaped cross-section.

3. The transition of claim 2, wherein the first and second sides have ends that are flared outward from a longitudinal axis of the elongated body.

4. The transition of claim 1, further comprising a second end attachment coupled to a second end of the elongated body that is generally opposite to the first end and closes the second end of the elongated body, whereby the second end attachment includes a slot for receiving the transition bracket rib.

5. The transition of claim 1, further comprising a slot in a top surface of the elongated body for receiving at least a portion of the transition bracket.

6. A heat shield for a transition bracket in a can-annular combustion system of a turbine engine, comprising:

a tubular elongated body configured to be coupled to a transition component proximate to an outer surface of the transition component and including a top surface having an opening for receiving the transition bracket and a bottom surface configured to be proximate to an outer surface of a transition component of a turbine engine;

an opening in the bottom surface of the elongated body;

a first end attachment coupled to a first end of the elongated body that closes the first end of the elongated body, whereby the first end attachment includes a slot for receiving a transition bracket rib; and a second end attachment coupled to a second end of the elongated body that is generally opposite to the first end and closes the second end of the elongated body, whereby the second end attachment includes a slot for receiving the transition bracket rib.

7. The heat shield of claim 6, wherein the transition bracket extends through the elongated body and away from the transition of the turbine engine.

8. The heat shield of claim 6, further comprising an adapter plate coupled to the transition bracket for retaining the elongated body proximate to the transition of a turbine engine.

9. The heat shield of claim 6, wherein the elongated body comprises a cross-section having generally hemispherical top portion supported by a first side that extends from the hemispherical top portion and forms a portion of the bottom surface and supported by a second side that extends from the hemispherical top portion and forms a portion of the bottom surface, whereby the first and second sides extend from the hemispherical shaped top portion and form a generally teardrop shaped cross-section.

10. The heat shield of claim 9, wherein the first and second sides have ends that are flared outward from a longitudinal axis of the elongated body.

11. The heat shield of claim 6, wherein the opening in the top surface of the elongated body for receiving at least a portion of the transition bracket is a slot.

12. A transition in a can-annular combustion system of a turbine engine having a heat shield, comprising:

a tubular elongated body configured to be coupled to a transition component proximate to an outer surface of the transition component and including a top surface having a slot for receiving a transition bracket and a bottom surface configured to be proximate to an outer surface of a transition component of a turbine engine;

an opening in the bottom surface of the elongated body for receiving the transition bracket;

a first end attachment coupled to a first end of the elongated body that closes the first end of the elongated body, whereby the first end attachment includes a slot for receiving a transition bracket rib;

a second end attachment coupled to a second end of the elongated body that is generally opposite to the first end and closes the second end of the elongated body, whereby the first end attachment includes a slot for receiving a transition bracket rib;

a transition bracket extending through the elongated body and away from a transition of a turbine engine; and an adapter plate coupled to the transition bracket for retaining the elongated body proximate to a transition of a turbine engine.

* * * * *